United States Patent [19]

Minter

[11] 4,327,955

[45] May 4, 1982

[54] REDUCED INSERTION FORCE CONNECTOR

[76] Inventor: Jerry B. Minter, Components Corporation, Denville, N.J. 07834

[21] Appl. No.: 78,326

[22] Filed: Sep. 24, 1979

[51] Int. Cl.[3] ..... H01R 13/62; H01R 23/70

[52] U.S. Cl. ..... 339/74 R; 339/75 MP; 339/176 MP

[58] Field of Search ..... 339/17 L, 74 R, 75 MP, 339/176 MP, 136 M, 198 G, 198 GA

[56] References Cited

U.S. PATENT DOCUMENTS

| | | | |
|---|---|---|---|
| 2,802,188 | 8/1957 | Badders | 339/17 L |
| 2,957,155 | 10/1960 | Ehrlich | 339/176 MP |
| 2,978,666 | 4/1961 | McGregor | 339/176 MP |
| 3,576,515 | 4/1971 | Frantz | 339/74 R |
| 3,634,806 | 1/1972 | Fergusson | 339/136 M |
| 3,793,609 | 2/1974 | McIver | 339/74 R |
| 4,076,362 | 2/1978 | Ichimura | 339/75 MP |
| 4,176,900 | 12/1979 | Hines et al. | 339/75 MP |

FOREIGN PATENT DOCUMENTS

| | | | |
|---|---|---|---|
| 56488 | 11/1968 | Poland | 339/176 MP |

OTHER PUBLICATIONS

IBM Tech. Discl. Bulletin, Agard et al., vol. 13, No. 9, p. 2612, 2/71.

*Primary Examiner*—Neil Abrams

[57] ABSTRACT

A connector for reduced insertion force includes one or more U-shaped insulators, each having two portions and a gap between them to receive a printed circuit board. A conductor is held by each insulator so that part of the conductor is free to move between first position in which the conductor extends into the gap and a second position retracted from the first position. In the first position, the conductor can make good electrical connection with a printed circuit board inserted into the gap; in the second position, the conductor exerts little or no force on the printed circuit board and therefore allows easier insertion of the board into the gap. The conductor may be a single M-shaped conductor or one or more generally U-shaped conductors attached to an insulator structure in the form of a wafer. A plurality of such wafers may be stacked so that their gaps are aligned and their conductors are spaced apart by a distance corresponding to standard printed circuit spacings. Channels are provided through the insulator to allow an elongated movable means to be inserted therein to engage the connectors when they are in one of their positions and urge them into the other position.

16 Claims, 7 Drawing Figures

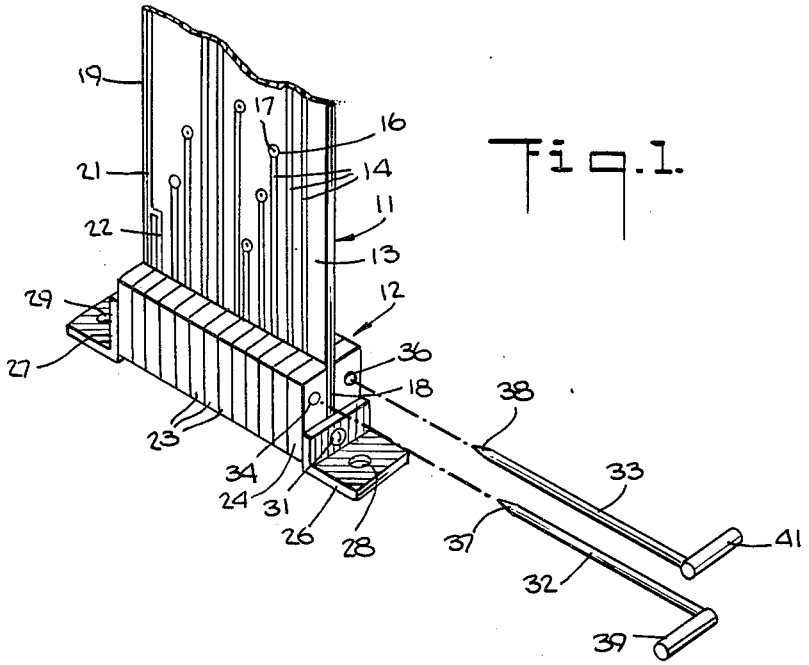
Fig. 1.
Fig. 3.
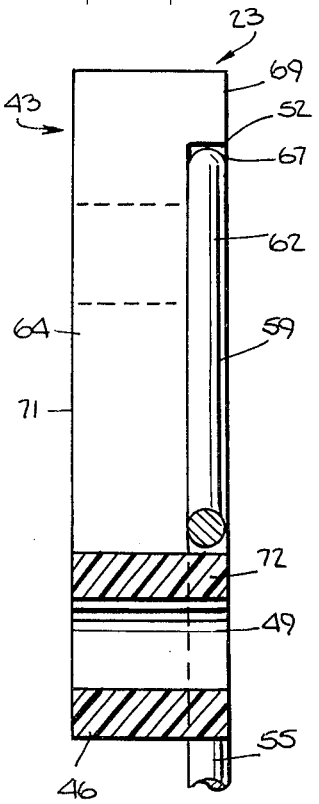
Fig. 2.
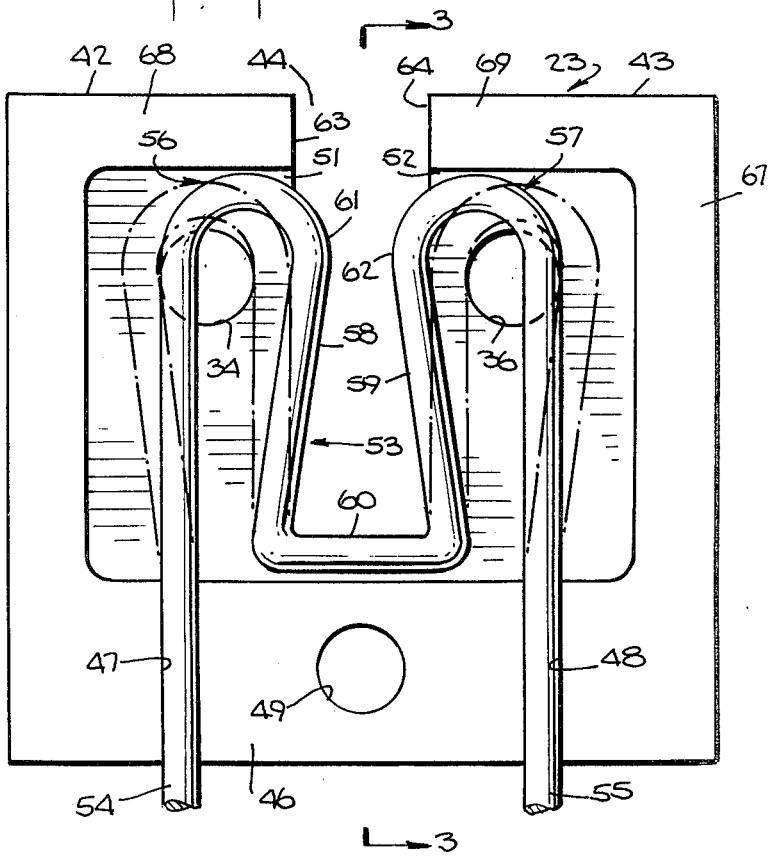

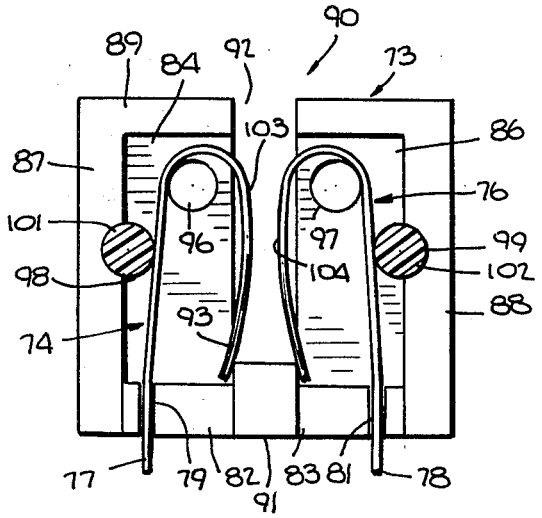
Fig. 4.
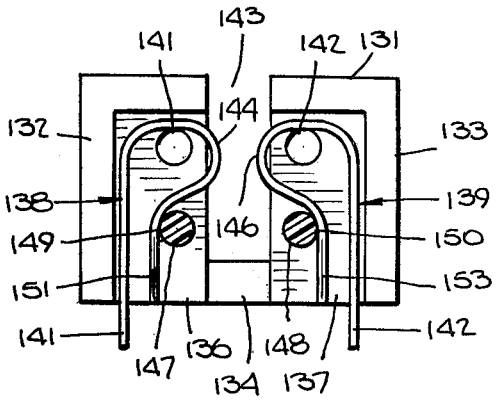
Fig. 6.
Fig. 5.
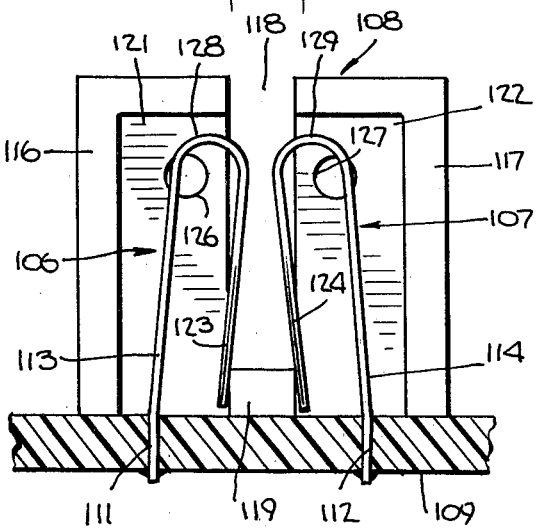
Fig. 7.
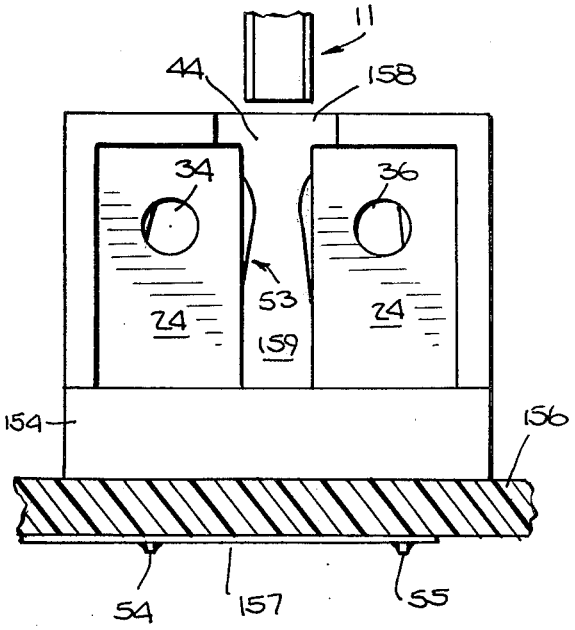

REDUCED INSERTION FORCE CONNECTOR

BACKGROUND OF THE INVENTION

1. Field of the Invention

This invention relates to the field of low, or zero, insertion force connectors, particularly to receive the edges of printed circuit cards and the like.

2. The Prior Art

Printed circuit cards, or boards, are normally relatively thin sheets of insulating material with conductive patterns formed on one surface, or usually both surfaces, by a printing technique that normally involves a photographic printing process. The conductive patterns may be electrical circuit components, such as inductors, capacitors, or resistors, but usually the patterns only form connecting links between specific circuit locations to which separately formed electrical components can be connected, usually by a soldering process.

Printed circuits, however formed, usually are arranged so that the terminals of the circuit are formed along a straight edge of the board to be inserted into a multi-conductor connector. This connector is mounted on another board, which is commonly called a mother board, and the board inserted into that connector is commonly called a daughter board. Some printed circuit boards are large enough to have over two hundred connections along the edge. If each of the connections must be inserted into good conductive relationship with a separate conductor in the multi-unit connector, and if each of the conductors exerts a half-pound pressure on the printed circuit board to be certain of making good electrical contact, the total pressure may therefore be more than 100 pounds. Although the pressure is perpendicular to the surface of the printed circuit board, it exerts a frictional force that interferes with movement of the board either into the connector or out of the connector, and the magnitude of such frictional force may be of the same order of magnitude as the total force exerted perpendicular to the surface of the board, depending on the coefficient of friction between the connectors and the surface against which they press.

There has long been a desire on the part of those in the electronics industry to have a connector capable of accepting the edge of a printed circuit board easily but with means for increasing the force exerted by the connector on the edge of the board after insertion. Most desirably, the connector should exert zero force while the edge of the printed circuit board is being inserted into the connector but should exert at least the normal force after insertion. This would permit a printed circuit board having as many contacts along its edge as is otherwise feasible to be inserted into a connector of corresponding length and having the appropriate number of connectors. Furthermore, it would make it possible to slide the printed circuit board into the connector along the longitudinal direction of the connector, rather than perpendicular to the longitudinal direction. This would make it possible to arrange connectors along opposite edges of a printed circuit board or even along three or all four edges of a printed circuit board.

Zero insertion force connectors have been proposed hereto fore in which an elongated cam member extending longitudinally along the connector is pivotal about an offset axis to exert a cam force that is in the proper direction to move all of the conductors of the connector simultaneously toward or away from the gap in which the printed circuit board is inserted. One of the disadvantages of such pivotally arranged devices is that they must be insulated from the individual conductors so as not to short circuit the conductors together. Another disadvantage is that, if such elongated cams are too long, the cumulative force of the conductors will make it necessary for the elongated cam to twist along its length, thereby causing each of the conductors to make contact and to break contact with the respective part of the printed circuit board at a time slightly different than the time of the next adjacent conductor. The torque that must be exerted to rotate the elongated cam is the sum of all conductor cam friction moments because of simultaneous actuations.

OBJECTS AND SUMMARY OF THE INVENTION

It is one of the objects of the present invention to provide a simplified way of manufacturing low insertion force connectors (where "low" includes "zero") by forming the complete connector of individual, wafer-like, units, each containing one or two conductors and capable of being stacked with like units to form a multi-terminal connector with as many conductors as may be desired.

Another object of the present invention is to provide simple, removable means for shifting each conductor in sequence either into or out of engagement with an elemental area of a printed circuit board, whether there is only one conductor or a multiplicity of them. The basic unit of a connector according to the present invention may be in the form of a wafer of insulating material that has two separated portions defining a gap between them. The two portions have substantially coplanar surfaces, and the insulator comprises a portion raised above, or perpendicular to, the first surface. An elongated, resilient conductor is held by means that allow some movement of the conductor parallel to the first surface and between a first position in which the conductor extends at least part of the way across the gap toward the second portion of the insulator and a second position retracted from the first position, or removed farther from the second portion of the insulator. In the first position, the conductor can exert substantial force on a conductive member, such as the edge of a printed circuit board, inserted in the gap; in the second position, the force, if any, exerted on such a conductive member would be substantially less and could even be zero. Movable means are provided to engage the conductor in one of the two positions and to press the conductor into the other of the positions. The insulator includes guide means to hold the movable means when the latter is in engagement with the conductor. The movable means can either move the conductor from its first position to its second position to facilitate inserting the edge of a printed circuit board into the gap or it can move the conductor from the second position into the first position to force the conductor into good conductive engagement with the printed circuit board.

When a plurality of such elemental sections are stacked together to form a multi-terminal connector, different ones of the insulator wafers can be color-coded to make it easier to identify which of the conductors is connected to a particular part of the printed circuit structure.

The conductors for the separate elemental wafer components of a multi-terminal connector can have one elongated conductor to make electrical contact with both sides of the printed circuit board, whether such contact is for the purpose of making electrical connection or is simply for the purpose of mechanically holding the printed circuit board in place. Such one-piece conductors may be generally M-shaped and formed as described and claimed in my U.S. Pat. No. 3,340,440. Such M-shaped conductors have been found to give excellent service as individual connectors for individual terminals of a printed circuit board, and by attaching each of such conductors to a separate insulator wafer shaped in the manner just described, the conductors can be held and inserted into mother boards with greater ease. Furthermore, the construction of a connector of the configuration just described permits the connector to have any number of terminals. It is not limited to an arbitrary number, such as fifty or one hundred but can be constructed to have sixty three or eighty seven, if the design of the printed circuit board makes such a number desirable. These numbers are random examples, not limitations.

A further advantage of the present invention is that it is not required that the spacing between adjacent conductors be identical. There are several standard spacings between adjacent conductors of a printed circuit board, and while it is common to use only one such standardized spacing on a given printed circuit board, the present invention makes it possible to use more than one such standard. The spacing between adjacent conductors is determined by the thickness of the elemental wafer components, and there may be several such thicknesses, each corresponding to one of the standardized printed circuit conductor spacings.

In an alternative configuration, the conductor for each elemental section can be divided into two U-shaped portions insulated from each other, one of which makes connection with a conductive terminal on one surface of a printed circuit board and the other of which makes connection with a terminal on the opposite surface. It is not necessary that these terminals be electrically short circuited together, and by dividing the conductor into two parts, the number of connections to a printed circuit board can be multiplied by two.

BRIEF DESCRIPTION OF THE DRAWINGS

FIG. 1 is a perspective view of a multi-terminal printed circuit connector constructed according to the present invention with a printed circuit board inserted into the connector.

FIG. 2 is an enlarged front view of one of the elemental components of the connector in FIG. 1, illustrating one of the embodiments of the invention.

FIG. 3 is a cross-sectional view of the connector section in FIG. 2 along the lines 3—3.

FIGS. 4–6 show different embodiments of elemental sections of printed circuit connectors that may be used in the assembly in FIG. 1.

FIG. 7 is an end view of a modified embodiment of a multi-terminal printed circuit connector according to the present incention.

DETAILED DESCRIPTION OF THE PREFERRED EMBODIMENTS

FIG. 1 shows one end of a printed circuit board 11 inserted into a multi-terminal connector 12. The printed circuit is formed on the insulating substrate 13 and is illustrated here by several typical conductive lines 14 formed on one surface of the substrate 13 by any suitable procedure, such as the usual photographic technique. It is common practice to have conductive lines formed also on the back surface of the substrate 13 where they would not be visible in this drawing.

Some of the lines have conductive pads, such as the pad 16 formed on them. It is typical for such pads to be formed around an aperture, such as the aperture 17, through the substrate 13 and used as mounting locations for electronic components, such as resistors, capacitors, transistors, and other components well known in the electronic art. It is also common practice to electroplate the surface of the channel through the substrate 13 at each of the apertures to make connections with conductors on the rear surface of the board.

With the board 11 fully inserted into the connector 12, most of the edge 18 of the board is not visible. However, it may be noted that the portions of the conductive lines 14 just outside of the connector 12 are all evenly spaced. This is standard practice in printed circuit technology because most connectors for receiving the edge of a printed circuit board are constructed as a unit with equal spacing between electrical terminal members inside the connectors, and these terminal members are necessarily evenly spaced from each other so that such connectors will be suitable for mass production. Although the end portions of the conductive lines 14 of a given printed circuit board 11 have a uniform spacing, industry standards allow for different, specific spacings on different boards.

At one edge 19 of the printed circuit board 11 is a conductive line 21, which is shown in this embodiment as merging with another conductive line 22 spaced from the line 21 by the same uniform spacing as between all of the other lines 14. It is advantageous in the present invention to use the line 21 as the ground connection for circuits on the printed circuit board 11 for reasons to be described hereinafter.

The connector 12 is shown as comprising a plurality of wafers 23. The wafers, which are of insulating material, are assembled in a stack and an insulating wafer 24, which may be somewhat different from the wafers 23 in that it contains no conductive member, is shown at the end of the stack. Two L-shaped mounting flanges 26 and 27 having mounting apertures 28 and 29, respectively, are bolted to the stack of now conductive wafers 23 and 24 by a long screw 31 that passes through the entire stack and through the flanges 26 and 27. The screw may be threaded into the flange 27 at one end or a nut that holds the entire assembly together may be on the end of the screw that is out of sight.

FIG. 1 also shows two elongated movable means 32 and 33 in the form of either metal or insulating pins that fit into apertures, or channels, 34 and 36, respectively, that extend through the entire stack of insulators 23 and 24. The pins are generally cylindrical and have tapered, or slanting, ends 37 and 38, respectively, and handles 39 and 41, respectively, at the other end. In order to describe the function of the pins 32 and 33, it is preferable to consider a typical one of the wafers 23.

FIGS. 2 and 3 show such a wafer, which may be molded or formed of any suitable material having good insulating and mechanical strength characteristics and being suitable for mass productions. Basically, the wafer is U-shaped and consists of two portions 42 and 43 separated by a gap 44 but joined together at one end by a third portion 46 that has two grooves, or notches, 47 and 48 in it. In this embodiment, the portion 46 also has an aperture 49 extending through it, and it is through this aperture that the screw 31 in FIG. 1 is inserted.

The portions 42 and 43 have substantially flat surfaces 51 and 52, respectively, which are substantially coplanar with each other. An elongated resilient conductor 53, which, in this embodiment, is M-shaped and has outer legs 54 and 55 that fit snugly into the notches 47 and 48, respectively, to hold U-shaped loops 56 and 57 close to the surfaces 51 and 52. The loops comprise the upper ends of the legs 54 and 55, that is the ends that are juxtaposed with respect to the surfaces 51 and 52, and downwardly extending parts 58 and 59, respectively, joined together at a bight 60.

It is to be noted that the parts 58 and 59 are not quite parallel with each other but are closer together in the areas 61 and 62, respectively, than they are at points closer to the bight 60. It is further to be noted that the areas 61 and 62 are closer together than the sides 63 and 64 that define the side of the gap 44. These sides 63 and 64 are far enough apart to allow a typical printed circuit board to be inserted into the gap easily, but the parts 51 and 52 of the conductor 53 are closer together than the thickness of the printed circuit board. Thus, when a printed circuit board, such as the board 11 in FIG. 1, is inserted into the gap 44 and forced between the parts 58 and 59 of the conductor 53, the areas 61 and 62 press sufficiently firmly against the opposite surfaces of the printed circuit board to make good electrical contact with any conductive lines thereon, such as the lines 14 in FIG. 1.

In order to facilitate insertion of a printed circuit board, such as the board 11 in FIG. 1, into the gap 44 in accordance with this invention, loops 56 and 57 are retracted to the positions shown in dotted lines in FIG. 2. This requires that the loops be moved parallel to the surfaces 51 and 52 and outwardly away from the gap 44. The channels 34 and 36, that extend through each of the insulators in the stack that makes up the connector 12 in FIG. 1 naturally extend through the wafer 23. The locations of the channels, or apertures, 34 and 36 are important. In the present embodiment in which the natural positions of the loops 56 and 57 is such that the areas 61 and 62 would press firmly against a printed circuit board inserted into the gap 44, the apertures 34 and 36 must be located so that the upper parts of the legs 54 and 55 extend partially across the respective apertures covering parts of the apertures away from the gap 44. These upper parts of the legs 54 and 55 must not cover more than half of the respective apertures 34 and 36 so as not to be in the way of the tapered ends 37 and 38 of the pins 32 and 33 shown in FIG. 1. Preferably the cylindrical portions of the pins 32 and 33 almost fill the respective apertures 34 and 36, and assuming that they do, they must push the upper parts of the legs 54 and 55 outwardly far enough to retract the areas 61 and 62 sufficiently to allow a printed circuit board to be inserted easily into the gap 44. Ideally, when the loops 56 and 57 are retracted to the positions shown in dotted lines in FIG. 2, there is no obstruction to prevent a printed circuit board from being inserted into the gap 44. This requires that the retraction of the loops be at least approximately equal to the distance that the respective areas 61 and 62 extend beyond the edges 63 and 64 that define the sides of the gap 44. This, in turn, requires that the radius of the pins 32 and 33 be at least equal to the extent that the areas 61 and 62 extend beyond the edges 63 and 64.

The portion 46 is identified as being along the bottom of the wafer 23, and the top and side edges of the substantially coplanar surfaces 51 and 52 are illustrated as being surrounded by a raised rim. The portion 46 constitutes the bottom part of this rim, side parts of the rim are identified by reference numerals 66 and 67, and the top parts of the rim are identified by reference numerals 68 and 69. The facing edges of the surfaces 51 and 52 have no rims, since the conductor 53 must be free to occupy this region. In the embodiment in FIGS. 2 and 3, the height of the various portions of the rim is uniform. In addition, the height should be at least as great as, and preferably slightly greater than, the diameter of the conductor 53. The reason is that the rim serves as a spacer to provide room for the conductor 53 to move as described without having to rub on either the surfaces 51 and 52 or the back surface 71 (see FIG. 3) of the next-adjacent wafer.

The pocket defined by the raised rim around the surface portions 51 and 52 also helps to hold the conductor 53 reasonably close to the position it must occupy. It is only necessary to hold the conductor until the legs 54 and 55 can be pressed into the notches, or slots, 47 and 48 to secure the conductor in place.

The thickness of the main body portion of the wafer 23 between the surface 52 and the surface 71 (see FIG. 3) when the wafers 23 are stacked together as shown in FIG. 1, is slightly less than the center-to-center spring between asjacent conductors to allow enough spacing so that each conductor can move parallel to the surface 52 of its wafer. The total thickness of the wafer 23 between the back surface 71 and the forwardmost surface 72, which, in the embodiment in FIGS. 2 and 3, constitutes the top of all of the portions of the rim, is equal to the center-to-center spacing between conductors in adjacent wafers.

FIG. 4 shows a wafer 73 generally similar to the wafer 23 in FIGS. 2 and 3. However, instead of having a single conductor, like the conductor 53 in FIG. 2, the wafer 73 has two separate conductors 74 and 76. These conductors are U-shaped and, in the embodiment shown, are mirror images of each other. Outer legs 77 and 78 of the U-shaped conductors 74 and 76 are held in slots 79 and 81 of bottom portions 82 and 83 of a rim that surrounds recessed, substantially coplanar surfaces 84 and 86. A rim comprising sections 87–90 extends around the outer edges and top edges of the surfaces 84 and 86, and a central member 91 between the two portions 82 and 83 completes the rim except for the area left open to constitute a gap 92.

As may be seen, the U-shaped members 74 and 76 have legs 93 and 94 that are somewhat shorter than the legs 77 and 78. The lower ends of the legs 93 and 94 press against opposite sides of the central member 91 of the rim, which thus serves as a means for preventing these inwardly directed legs 93 and 94 from moving together and short circuiting each other. By keeping them apart, they may be connected to different points in a circuit on a printed circuit board of the type illustrated by the board 11 in FIG. 1, even though the U-shaped conductors 74 and 76 are substantially coplanar.

As a further means of holding the U-shaped conductors 74 and 76 in place, at least while the wafer 73 is being assembled, the wafer may include two low, cylindrical posts 96 and 97 around which the U-shaped conductors 74 and 76 are placed. These posts, together with the notches 79 and 81 hold the conductors reasonably well until the entire connector can be assembled.

Another distinction between the embodiment shown in FIGS. 2 and 3 and that shown in FIG. 4 is that, in FIG. 4 there are two channels 98 and 99 that are generally outside of the location of the upper parts of the legs 77 and 78. As may be seen, when these channels are filled with elongated members, here illustrated only in cross-section and identified by reference numerals 101 and 102, the upper portions of the U-shaped members 74 and 76 are pushed toward each other to cause areas 103 and 104 to press against any conductor, such as a printed circuit, inserted into the slot 92, provided, of course, that the conductor has the thickness for which the wafer 73 was designed. Since the areas 103 and 104 would contact the printed circuit inserted in the slot 92 only when the elongated members, or pins 101 and 102 were in place in the channels 98 and 99, these pins would have to be made of, or coated with, insulating material so that the conductors 74 and 76 of one wafer would not be short circuited to corresponding conductors of the next wafer and other wafers in a stack.

It is not necessary that the various portions 82, 83, and 87–91 all extend upwardly, or outwardly, from the substantially coplanar surfaces 84 and 86 by the same distance. It is desirable that the portions 82 and 83 extend outwardly far enough to allow the slots 79 and 81 to be deep enough to hold the legs 77 and 78 securely. Other parts of the rim of the wafer 73 could have different heights, provided only that there be matching structures on the back surface of each of the wafers 73 so that the frontwardly facing rim portions would mesh properly with the rearwardly facing rim or recessed portions of the next adjacent wafer 73.

FIG. 5 illustrates an embodiment that, like FIG. 4, has two separate U-shaped conductors instead of a single M-shaped conductor as the embodiment in FIGS. 2 and 3. The conductors 106 and 107 are actually quite loosely held within the confines of a wafer 108. The main structure holding the conductors 106 and 107 is a printed circuit board 109 that has apertures 111 and 112 through which outer legs 113 and 114 of the U-shaped conductors 106 and 107 extend. As may be seen, both of the legs 113 and 114 are soldered in place on the opposite side of the printed circuit board 109 from the main part of the wafer 108.

The insulating part of the wafer 108 comprises a generally U-shaped structure having two portions 116 and 117 separated by a gap 118. A third portion 119 of the wafer 108 joins the two portions 116 and 117 at one end to complete the U-shaped configuration. The portions identified as 116, 117, and 119 may also be considered to constitute the rim around a recessed area having two substantially coplanar surfaces 121 and 122.

Unlike the previous embodiments, most of the lower portions of the wafer 108 is open. The central portion 119 serves as an insulator to prevent the reverse-bent, downwardly extending legs 123 and 124 of the U-shaped conductors 106 and 107 from coming into contact with each other. Apertures 126 and 127 partially overlapped by the loop portions 128 and 129 of the U-shaped conductors 106 and 107 allow pins of the type illustrated by the pins 32 and 33 in FIG. 1 to be inserted through the wafer 108 to spread the U-shaped conductors 106 and 107 far enough apart to allow easy insertion of a printed circuit board. The central portion 119 also keeps the lower ends of the legs 123 and 124 from extending into the gap 118 and interfering with insertion of a printed circuit board when the pins 32 and 33 are inserted into the apertures 126 and 127.

FIG. 6 shows still another embodiment. Like FIG. 5, the structure in FIG. 6 includes a wafer 131 of generally U-shaped configuration having two raised portions 132 and 133 and a central raised portion 134 substantially surrounding a recessed portion having two coplanar surfaces 136 and 137.

The structure in FIG. 6 includes two conductors 138 and 139 bent so as to have outer legs 140 and 141 spaced well apart and intended to be held primarily by insertion in a printed circuit board, such as the printed circuit board 109 in FIG. 5. The conductors 138 and 139 curve around a pair of raised pedestals 142 and 143, which help to hold the conductors in place during assembly of the wafer 131 and of a stack of such wafers. Exact positioning of the conductors 138 and 139 in this embodiment, as in the embodiment in FIG. 5, may be achieved by inserting the outer legs 140 and 141 into apertures in a printed circuit board, like the board 109 in FIG. 5, and then placing a gauging sheet of predetermined thickness into the slot 143 between the portions 132 and 133 to allow contact areas 144 and 146 of the conductors 138 and 139, respectively, to engage the gauging sheet. Threrafter, while the conductors are so spaced, they may be soldered to the printed circuit board to hold that spacing fixed, even after the gauging sheet is removed.

Like the other embodiments, the wafer 131 in FIG. 6 includes two apertures, or channels, 147 and 148, which are shown as being filled by two elongated, movable means 149 and 150, which may be the same as the pins 32 and 33 in FIG. 1. The pins 149 and 150 force inner legs 151 and 152 of the conductors 138 and 139 apart to allow a printed circuit board to be inserted easily into the gap 144. In this instance, the contact areas 145 and 146 are not retracted so far as to eliminate completely any engagement between them and the printed circuit board while the printed circuit board is being inserted into the gap 143. However, the insertion force is substantially diminished by pushing the conductor legs 151 and 152 farther apart during insertion of the printed circuit board.

FIG. 7 shows a molded outer case, or enclosure, 153 that substantially surrounds a stack of wafers of any of the foregoing embodiments. Such a stack may be the stack as shown in FIG. 1 but without the flanges 26 and 27 illustrated there. Instead, the enclosure 153 includes a pair of outwardly extending end portions, of which only the end portion 154 is shown in this figure. The entire connector is shown mounted on a printed circuit board 156. Assuming that the wafers contained within the enclosure 153 are those shown in FIGS. 2 and 3, the outer legs 54 and 55 of such wafers are shown extending through the printed circuit board 156 and soldered to printed connector means 157 on the opposite side of that board. The legs 54 and 55 are cut off so that they do not extend far beyond the printed circuit connector 157. The two side portions of the end wafer 24, which merely serves to contain the conductor 53 of the next adjacent wafer 23 (FIG. 1) are shown in FIG. 7. Small portions of conductor 53 can be seen through the apertures 34 and 36 and in the gap 44. An end of a printed circuit board 11 is shown directly over the gap 44 and in position to be inserted therein as soon as the pins 32 and 33 have been inserted into the apertures 34 and 36 to retract the conductors 53. The outer case 153 has a gap 158 that is at least as wide as the gap 44 to allow easy entry of the printed circuit board 11 into the gap 44.

The far end 159 of the enclosure 153 is shown as comprising a solid member. This serves as a guide, so that if the printed circuit board 11 is inserted into the gap 44 and pushed back against the end wall 159, the various printed circuits on the board 11 will be properly aligned with all of the conductors of all of the wafers 23 held within the enclosure 153.

After the printed circuit board 11 has been inserted into the gap 44, the pins 32 and 33, shown in FIG. 1, are withdrawn from the apertures 34 and 36, allowing the conductors of the individual wafers 23 to move into engagement with the respective conductive lines on the printed circuit board 11. Since the main part of the pins 32 and 33 is cylindrical and only the ends 37 and 38 are tapered, it is only as these tapered ends reach a point opposite the respective conductors of the wafers 23 that those conductors can begin to move into place against the conductors on the printed circuit board 11. Thus, the conductors at the far end are the first to make contact and that is why, in FIG. 1, special mention was made of the conductive lines 21 and 22. These are preferably the ground lines for circuits on the printed circuit board 11. Thus the ground connection is made first, which is very advantageous in dealing with integrated circuits, which can easily be destroyed by stray electric fields.

In the case of the structures in which the pins 32 and 33 are of insulating material and are to be inserted in order to press the conductors against the printed circuit board, as is the case in the embodiment in FIG. 4, the first of the conductors 74 and 76 in a stack of wafers 73 to engage conductors on the printed circuit board will be those first encountered by the cylindrical portion of the pins 32 and 33. For a stack of wafers 73, it should therefore be the wafer or wafers at the other end of the stack from the end shown in FIG. 1 that would be connected to ground. In a structure in which the pins 32 and 33 were of insulating material, the mother board on which the connector was located could be energized before the pins 32 and 33 were inserted. The arrangement of the conductive lines on the printed circuit board 11 could be made such that, as the insulating pins 32 and 33 were inserted, successive circuits were made operative in the proper sequence. In fact, such a connector could be used as a simple sequencing switch.

While the invention has been described in terms of specific embodiments, it will be understood by those skilled in the art that modifications may be made therein without departing from the scope of the invention as defined by the following claims.

What is claimed is:

1. A reduced insertion force connector comprising:

a plurality of U-shaped insulator wafers, each comprising first and second laterally separated, opposite portions defining a gap therebetween and having first and second substantially coplanar surfaces, respectively, a third portion joining the first and second portions, and an insulating spacing portion raised above the first surface;

a plurality of elongated, resilient M-shaped conductor means of round cross section and comprising first and second U-shaped loop portions parallel, respectively, to the first and second substantially coplanar surfaces, each of the loop portions having an end extending beyond the third portion and clear of the insulator wafer, the M-shaped conductor comprising a central bight between the loop portions, parts of the loop portions defining the central bight being located on the U-shaped insulator to allow a conductive member inserted into the gap between the laterally separated portions to make contact with at least one side of the bight and to be received between the two parts defining the bight;

means to hold a first portion of at least one of the conductor means relatively stationary adjacent the first portion of each of the wafers, respectively, while permitting a second portion of the same conductor means adjacent the loop portion thereof to move parallel to the first surface of the respective one of the wafers between a first position extending at least part of the way across the gap toward the opposite portion of the same wafer, in which position the second portion of the same conductor means can exert a substantial pressure on a conductive member of predetermined thickness inserted in the gap, and a second poistion farther removed from the opposite portion of the same wafer; and movable means to engage the conductor means in one of the positions and to press the second portion of the conductor means into the other of the positions, each of the insulator wafers comprising guide means to hold the movable means then the movable means is in engagement with the conductor.

2. The invention defined in claim 1 in which the guide means comprises a surface portion of the insulator substantially perpendicular to the coplanar surfaces and defining a channel to hold the movable means, the channels of all of the wafers being aligned with each other, and the movable means being an elongated member the longitudinal dimension of which is substantially perpendicular to the coplanar surfaces when the movable means is pressing the conductor into the other of the positions.

3. The invention defined in claim 1 in which the means to hold the conductor holds it in the first position, and the movable means moves it into the second position.

4. The invention defined in claim 3 in which the movable means is a metal rod movable substantially perpendicularly to the coplanar surfaces and comprising a slanting surface at the end thereof to wedge the conductor away from the first position when the rod is moved into engagement with the conductor.

5. The invention defined in claim 3 in which the movable means is an insulating rod movable substantially perpendicularly to the coplanar surfaces and comprising a tapered end to wedge the conductor away from the first position when the rod is moved into engagement with the conductor.

6. The invention defined in claim 1 in which the means to hold the conductor holds it to be normally in the second position, and the movable means is an insulating rod comprising a tapered end to wedge the conductor away from the second position and into the first position.

7. The invention as defined in claim 1 in which the guide means are located in the first and second laterally separated portions of each of the insulator wafers and comprise, respectively, first and second channels therethrough, the U-shaped portion of each of the elongated resilient conductors extending partially across the respective channels, the movable means comprising first and second members insertable into the first and second channels, respectively, and engaging the respective loop portions of each of the conductors to press each of the loop portions to an alternative position.

8. The invention as defined in claim 7 in which the parts of the loop means defining the bight are normally closer together than the thickness of the member inserted therebetween, whereby at least one of the parts of the U-shaped portions conductively engages the conductive member.

9. The invention as defined in claim 8 in which the conductive member is a printed circuit comprising thin conductive surface portions and a relatively thick insulating portion supporting the conductive portions.

10. A reduced insertion force connector comprising:

a plurality of U-shaped insulator wafers, each comprising first and second laterally separated, opposite portions defining a gap therebetween and having first and second substantially coplanar surfaces, respectively, a third portion joining the first and second portions, and an insulating spacing portion raised above the first surface;

applurality of elongated, resilient conductor means, each comprising:

a first elongated, U-shaped, resilient conductor comprising an outer leg, an inner leg, and a loop portion joining the inner and outer legs, and a second elongated, U-shaped, resilient conductor comprising an outer leg, an inner leg, and a loop portion joining the outer and inner legs of the second U-shaped conductor;

means to hold an end portion of the outer leg of each of the conductors adjacent the first and second portion of one of the wafers, respectively, while permitting a second portion of the conductors adjacent the respective loop portions to move parallel to the coplanar surfaces of the insulator wafers between a first position extending at least part of the way across the gap toward the opposite portion of the same wafer, in which position the inner leg of the same conductor can exert a substantial pressure on a conductive member of predetermined thickness inserted in the gap, and a second position farther removed from the opposite portion of the same wafer;

first unitary body movable means to engage the first conductor at the interior of the loop portion thereof in one of the positions and to press the second portions of each of the first and second conductors into the other of the positions, each of the insulator wafers comprising first guide means to engage and hold the first movable means when the first movable means is in engagement with the conductor; and second unitary body movable means to engage the second conductor in the interior of the loop portion thereof in one of the positions thereof and to press the second conductor into the other of the positions thereof, the insulator comprising second guide means to engage and hold the second movable means when the second movable means is in engagement with the conductors.

11. The invention as defined in claim 10 in which one end of each of the conductors extends beyond the perimeter of the insulator beyond the third portion of the insulator, the insulator further comprising surface portions to engage the other end of each of the U-shaped conductors to separate the conductors electrically from each other.

12. The invention as defined in claim 10 in which the thickness of the respective wafers is substantially equal to a standard spacing between adjacent conductors of a printed circuit.

13. The invention as defined in claim 10 in which different ones of the wafers are differently color coded in the connector.

14. The invention as defined in claim 10 comprising, in addition:

a channel through a corresponding portion of each of the wafers, whereby when the wafers are stacked together, the channel extends through all of them; and mechanical holding means extending through the channel to hold all of the wafers together and in alignment with each other.

15. The invention as defined in claim 10 comprising, in addition, trough-like holding means to hold a plurality of the wafers in alignment as an elongated, edge connector.

16. The invention as defined in claim 15 in which the trough-like means comprises an end gap in at least one of its ends, the end gap being aligned with the gap in each of the wafers to permit a printed circuit member to be inserted lengthwise along the trough-like means while the respective conductors are in their respective second positions.

* * * * *